US010180217B2

(12) United States Patent
Vang et al.

(10) Patent No.: US 10,180,217 B2
(45) Date of Patent: Jan. 15, 2019

(54) LED ARCHITECTURAL LUMINAIRE HAVING IMPROVED ILLUMINATION CHARACTERISTICS

(71) Applicant: Hubbell Incorporated, Shelton, CT (US)

(72) Inventors: Seng Vang, Greer, SC (US); Martin C. Werr, Easley, SC (US); David J. Rector, Mauldin, SC (US); Randy K. Lewis, Greenville, SC (US); Raymond A. Brown, Greer, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/208,694

(22) Filed: Mar. 13, 2014

(65) Prior Publication Data

US 2014/0268759 A1 Sep. 18, 2014

Related U.S. Application Data

(60) Provisional application No. 61/790,005, filed on Mar. 15, 2013.

(51) Int. Cl.

| | |
|---|---|
| ***F21K 99/00*** | (2016.01) |
| ***F21S 8/02*** | (2006.01) |
| *F21V 5/02* | (2006.01) |
| *F21V 7/00* | (2006.01) |
| *F21Y 103/10* | (2016.01) |
| *F21Y 115/10* | (2016.01) |

(52) U.S. Cl.
CPC ..... *F21S 8/026* (2013.01); *F21V 5/02* (2013.01); *F21V 7/005* (2013.01); *F21Y 2103/10* (2016.08); *F21Y 2115/10* (2016.08)

(58) Field of Classification Search
None
See application file for complete search history.

(56) References Cited

U.S. PATENT DOCUMENTS

| | | | |
|---|---|---|---|
| 6,007,217 | A | 12/1999 | Ferrier |
| 7,824,071 | B2 | 11/2010 | Zheng |
| 7,854,534 | B2 | 12/2010 | Liu |
| 7,901,105 | B2 | 3/2011 | Fowler, Jr. et al. |
| 7,918,575 | B2 | 4/2011 | Ho |
| 7,926,974 | B2 | 4/2011 | Wung et al. |
| 8,052,300 | B2 | 11/2011 | Zhang et al. |
| 8,128,256 | B2 | 3/2012 | Kim et al. |
| 8,201,967 | B2 | 6/2012 | Ramer et al. |
| 8,231,243 | B1 | 7/2012 | Boissevain et al. |
| 8,251,541 | B2 | 8/2012 | Lin |

(Continued)

FOREIGN PATENT DOCUMENTS

| | | | |
|---|---|---|---|
| WO | 2009157468 | A1 | 12/2009 |
| WO | 2010024507 | A1 | 3/2010 |

*Primary Examiner* — Britt D Hanley
(74) *Attorney, Agent, or Firm* — Michael Best & Friedrich, LLP

(57) ABSTRACT

An LED architectural luminaire for providing the lighting characteristics of a fluorescent luminaire comprises an LED mounting plate having angled sides for mounting strips of LEDs to allow the LEDs to illuminate the entire face of the luminaire to achieve bat-wing light distribution and a favorable spacing criteria of about 1.5.

19 Claims, 13 Drawing Sheets

(56) References Cited

U.S. PATENT DOCUMENTS

| | | | | |
|---|---|---|---|---|
| 8,272,763 | B1 * | 9/2012 | Chinnam | F21V 29/004 362/147 |
| 8,360,620 | B1 | 1/2013 | Rashidi | |
| 2011/0090687 | A1 | 4/2011 | Lin et al. | |
| 2011/0141738 | A1 | 6/2011 | Ogura | |
| 2012/0033420 | A1 | 2/2012 | Kim et al. | |
| 2012/0146512 | A1 | 6/2012 | Kim | |
| 2012/0155073 | A1 † | 6/2012 | McCanless | |
| 2012/0206909 | A1 | 8/2012 | Morgan | |
| 2013/0193857 | A1 * | 8/2013 | Tlachac | H05B 37/02 362/228 |
| 2014/0078728 | A1 * | 3/2014 | Rodgers et al. | 362/225 |
| 2014/0104843 | A1 † | 4/2014 | McCane | |

* cited by examiner
† cited by third party

LED ARCHITECTURAL LUMINAIRE HAVING IMPROVED ILLUMINATION CHARACTERISTICS

CROSS-REFERENCE TO RELATED APPLICATIONS

This application claims priority under 35 U.S.C. § 119(e) to U.S. Provisional Application 61/790,005, filed Mar. 15, 2013, the contents of which are hereby incorporated by reference in their entirety.

FIELD OF THE INVENTION

The present invention relates generally to LED lighting fixtures. More particularly, the present invention relates to an LED architectural luminaire having improved illumination characteristics.

BACKGROUND OF THE INVENTION

Lighting fixtures are known in the art. Since the invention of the incandescent light bulb, or lamp, lighting fixtures housing incandescent lamps have been deployed in countless environments in countless configurations. The development of the fluorescent lamp and its concomitant energy savings led to their widespread use and placement in areas previously populated with incandescent lights. Today, fluorescent fixtures vastly predominate in many places, especially business and commercial settings where energy cost savings are amplified.

Overtime, fluorescent fixtures have been modified to not only improve upon the aesthetic look of the fixtures, but also the light scattering characteristics. As the industry shifts to newer energy saving technologies, such as light emitting diodes (LEDs), the desire to maintain the aesthetics and superior lighting characteristics of existing fluorescent fixtures remains. In other words, prior artisans are seeking to develop an LED fixture that has the outward appearance of an existing fluorescent fixture, while also providing the uniform "bat wing" light output, even luminousity, and favorable spacing criteria of fluorescent fixtures.

A number of prior artisans have attempted to achieve these goals by replacing the elongated lamps of fluorescent fixtures with strips of LEDs. These and other prior artisans have recognized that the swapping of LEDs in the place of fluorescent bulbs does result in the superior lighting characteristics of the original fixtures. Problems encountered include inferior brightness, uneven luminosity, presence of dark areas, inability to create a "bat wing" distribution of light, and poor spacing criteria.

In an effort to overcome these drawbacks with LED lighting fixtures, some prior artisans have attempted to increase the number or brightness of the LEDs by using multiple strips of LEDs or larger diodes. Other prior artisans have attempted to address these problems by modifying the size, shape, or angles of the reflectors and lenses of the fixtures. And still others, have attempted to address these problems by a combination of these methods. To date, those in the art have failed to solve the problems in successfully deploying LED lighting in place of traditional fluorescent lighting.

The foregoing highlights the long-felt, yet unresolved, need in the art for an LED lighting fixture that overcomes the problems in the art. The foregoing also highlights the long-felt, yet unresolved, need in the art for methods of using LEDs in a manner that results in suitable lighting characteristics.

SUMMARY OF THE INVENTION

Various embodiments of the present invention overcome various of the drawbacks in the art and offer other advantages features as well. According to one aspect of various embodiments of the present invention there is provided an LED light fixture having the same general outward appearance as prior art fluorescent architectural luminaires and having a light output affording the same general favorable spacing criteria.

According to an advantageous embodiment of this aspect of the invention there is provided a LED mounting plate assembly having a flat central section and opposing downwardly angled sides. Mounted along the length of the angled sides are LED strips, whereby the LEDs irradiate light at an angle relative to the floor One advantageous feature of this aspect of the invention is the ability to ensure a "bat-wing" distribution of light. Another aspect of this embodiment of the invention is the ability to keep a favorable spacing criteria that rivals that of prior art fluorescent fixtures. Another aspect of this embodiment of the invention is the ability to achieve even luminousity that rivals that of fluorescent fixtures deployed in a work area.

In a presently preferred embodiment, the angle of the LED mounting surfaces are between 20° and 30° from horizontal. In a particularly preferred embodiment involving use of LEDs in a SERRANO™ fixture, the angle of the mounting surfaces is about 21 degrees.

According to another advantageous aspect of some embodiments of the invention is the provision of end caps on the fixture to block dark areas resulting from the end of the LED strips from being discernible by the viewer, thereby overcoming another drawback in the art.

The invention as described and claimed herein should become evident to a person of ordinary skill in the art given the following enabling description and drawings. The aspects and features of the invention believed to be novel and other elements characteristic of the invention are set forth with particularity in the appended claims. The drawings are not intended to limit the scope of the invention. The following enabling disclosure is directed to one of ordinary skill in the art and presupposes that those aspects of the invention within the ability of the ordinarily skilled artisan are understood and appreciated.

BRIEF DESCRIPTION OF THE DRAWINGS

The above benefits and other advantages of the various embodiments of the present invention will be more apparent from the following detailed description of exemplary embodiments of the present invention and from the accompanying drawing figures, in which.

The drawings are to scale where indicated on the Figures as will be clear to one of ordinary skill in the art.

DETAILED DESCRIPTION OF THE EXEMPLARY EMBODIMENTS

While the present invention will be described in connection with embodiments of the invention designed to mimic the appearance and footprint of prior art SERRANO™ luminaires, it will be readily apparent to one of ordinary skill in the art armed with the present specification that the present invention can be applied to any suitable luminaire in any suitable environment through routine experimentation.

The assignee of the present application sells a line of aesthetically pleasing architectural luminaires sold under the trade name "SERRANO." Presently, these luminaires come in standard 1'×4', 2'×2', and 2'×4' versions with alternative aesthetic central lens design. Many details of the SERRANO™ operation and appearance are available in Applicant's co-pending U.S. Ser. No. 13/687,124, filed Nov. 28, 2012, which is hereby incorporated-by-reference in its entirety.

Providing customers with the aesthetics while meeting the favorable spacing of the SERRANO™ line in an LED version would prove impossible based on the conventional wisdom in the art when it comes to LED luminaires. However, the present inventors went against the weight of authority and achieved an LED version of the SERRANO™ line that, for all intents and purposes, looks identical to the fluorescent versions and provides the desired light output characteristics.

Figure 1:
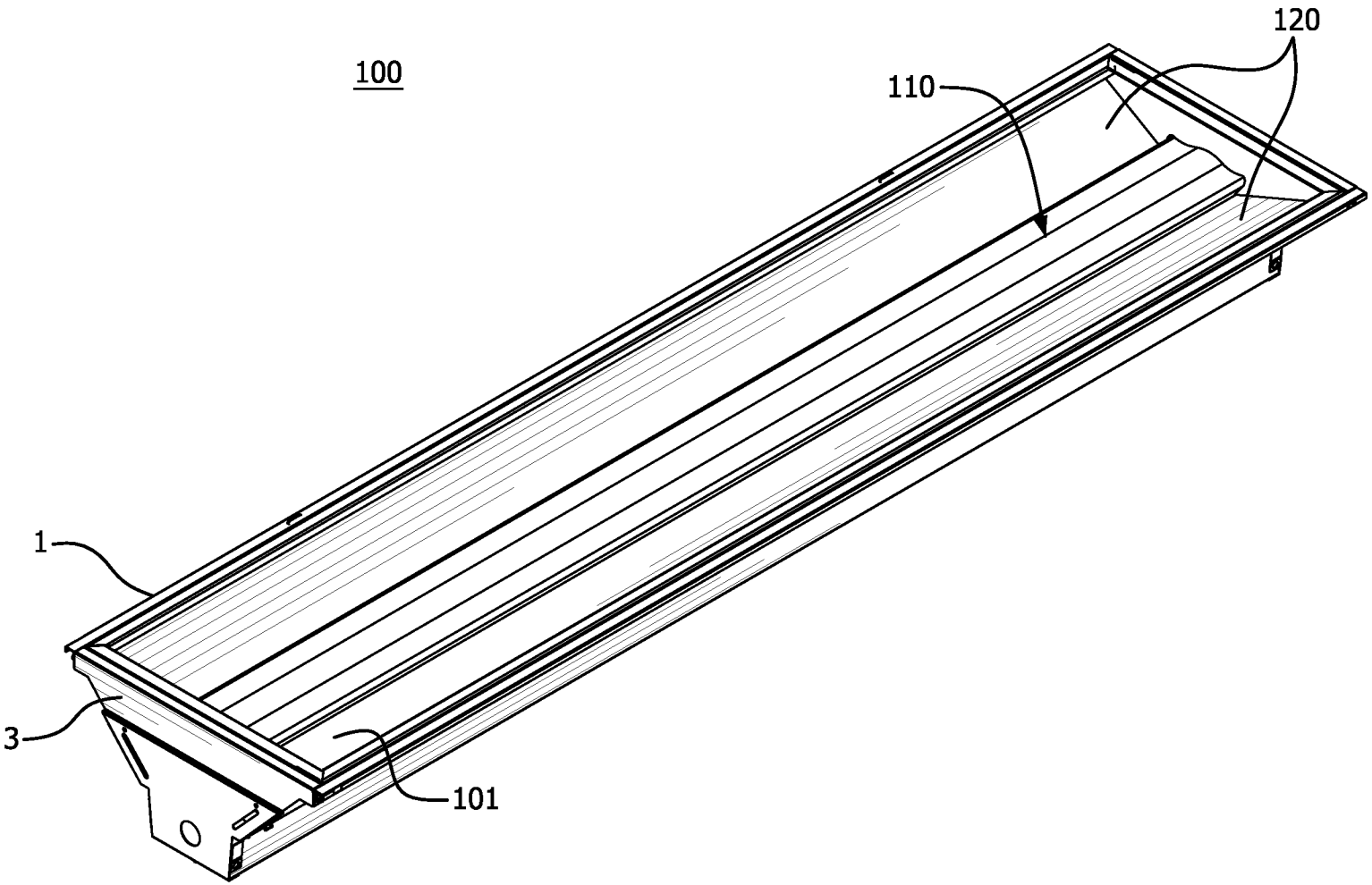
FIG. 1 depicts a perspective view of a 1'×4' architectural luminaire embodiment according to the invention.

FIG. 1 depicts a 1'×4' version of an LED SERRANO™ according to the invention. As depicted, similarly to the fluorescent SERRANO™, the fixture 100 includes a housing 1 laterally surrounding the optical and electrical elements of the fixture. The fixture includes an end cap 3 on each end that serves not only to complete the housing, but also include light seals 2 to prevent dark areas from being visible to the user. The fixture 100 includes a hinged and pivottable lens door 101 secured to the housing 1. The lens door includes an ornate and aesthetically pleasing prismatic central lens 110 flanked by straight, but angled sided lenses 110.

Figure 2:
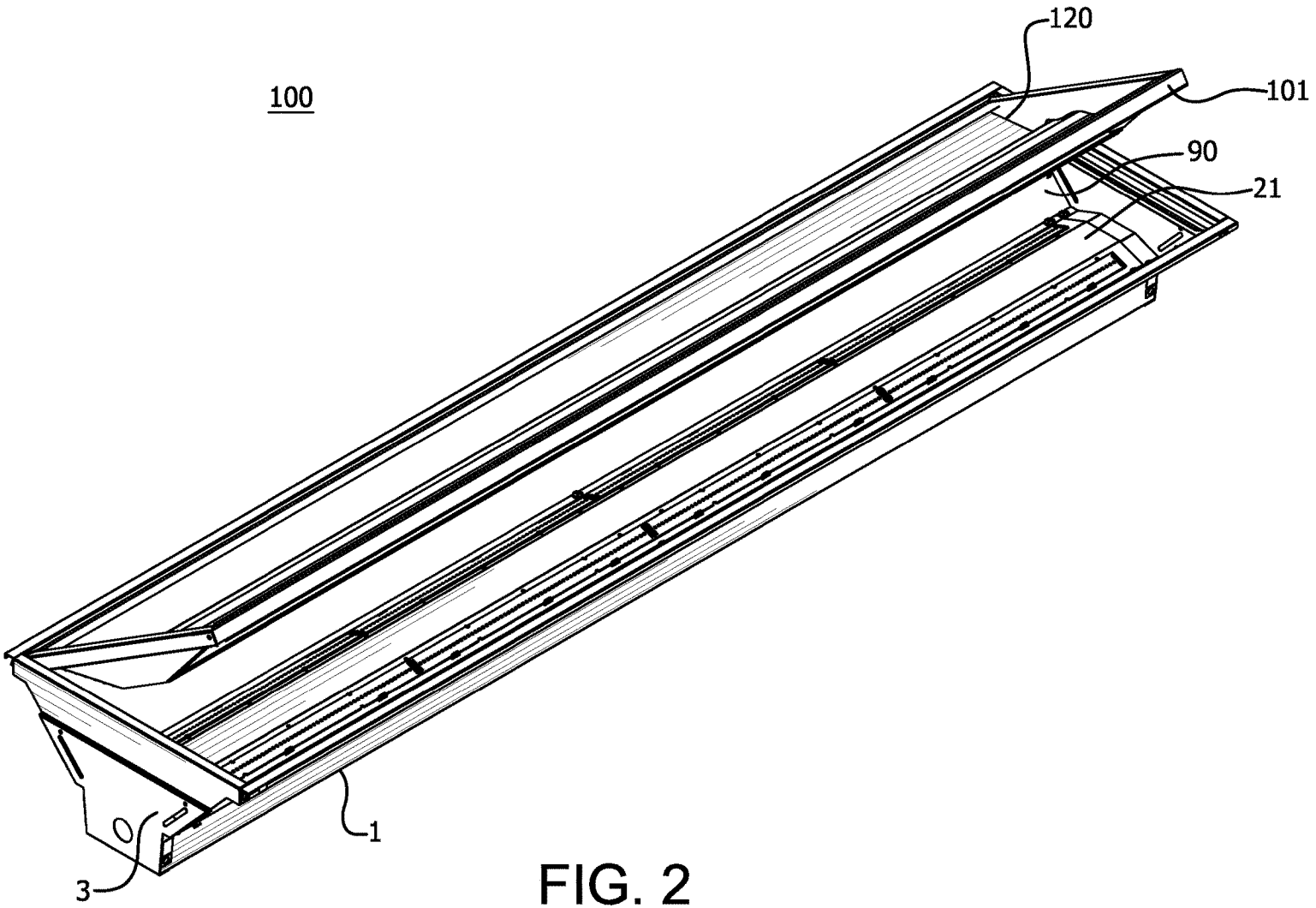
FIG. 2 depicts a perspective view of the luminaire embodiment of FIG. 1 with the lens door open.
Figure 3:
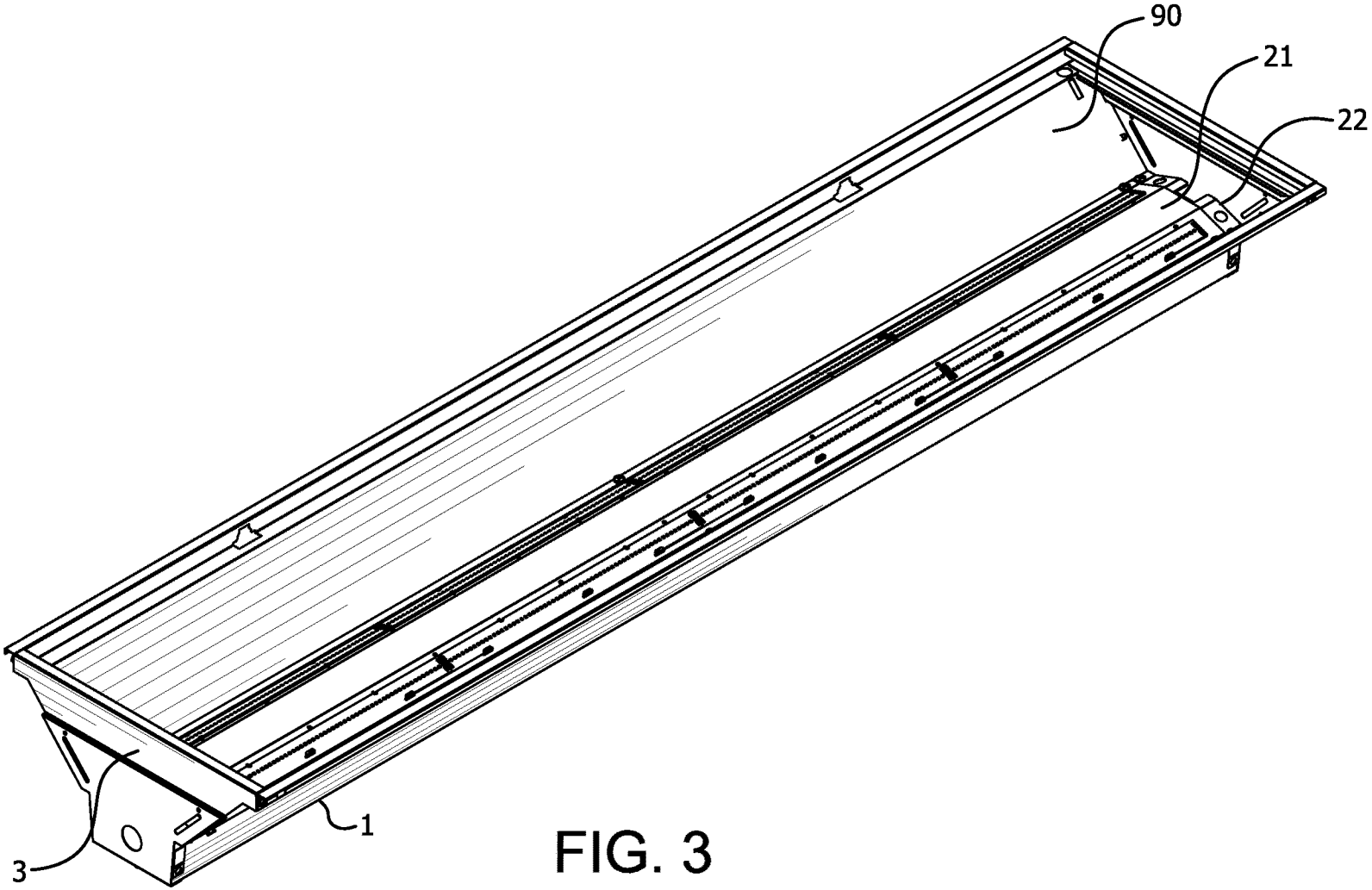
FIG. 3 depicts a perspective view of the luminaire of FIGS. 1 and 2 with the lens door removed.

As best shown in FIGS. 2 and 3, the door 101 may be actuated on its hinge to provide a user access to the interior of the fixture 100 for, in the case of the original fluorescent SERRANO™, replacing lamps or servicing the ballast by pivoting the hinged reflector 90, and in the case of the LED version, accessing the interior electrical components including the LED mounting plate 21, LED strips 22, and the internal electrical components positioned below the pivoting internal reflector 90.

Figure 4:
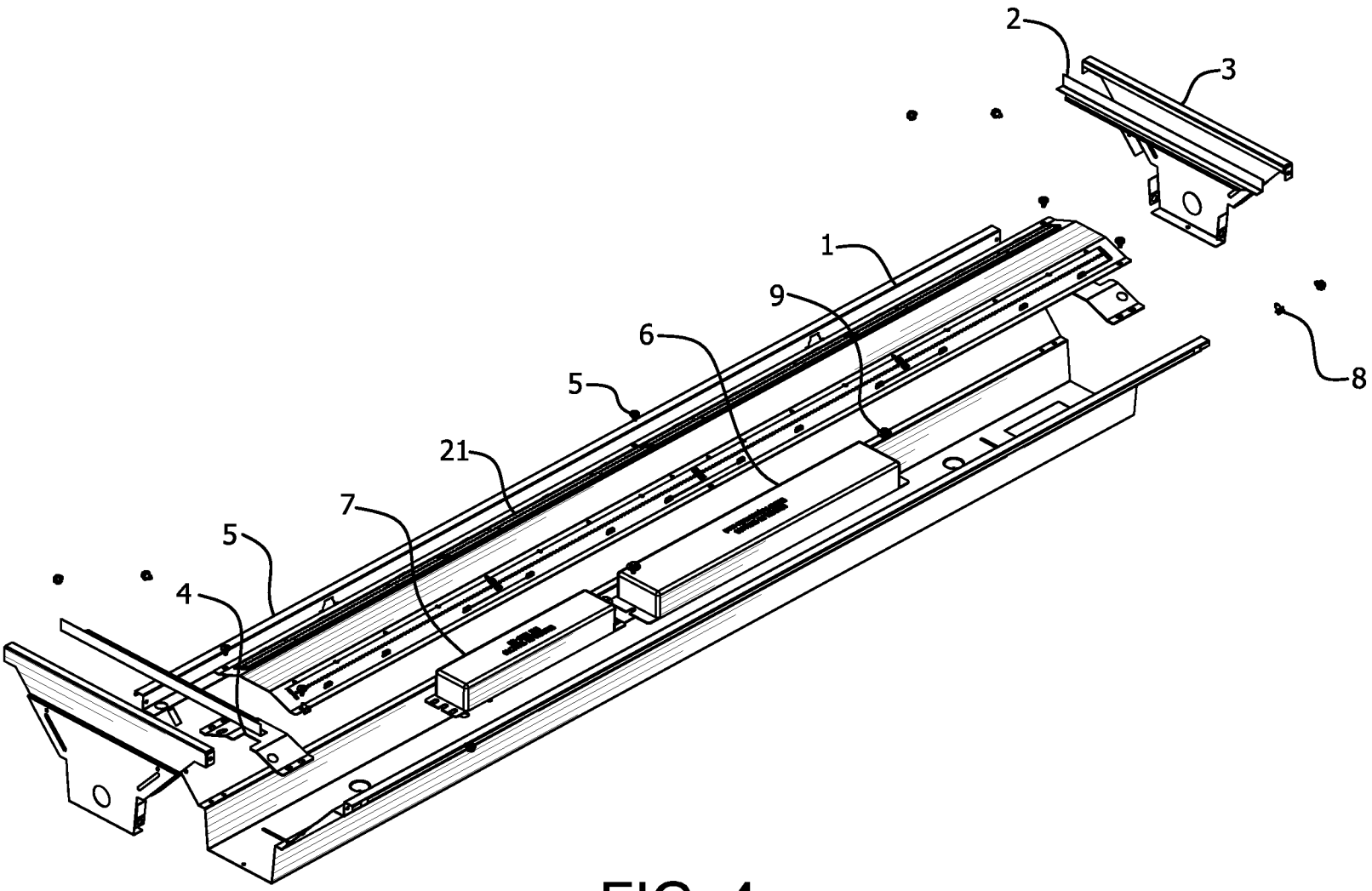
FIG. 4 is a exploded view of the partial luminaire of FIG. 3.

Turning to FIG. 4, the major components of the fixture 100 that lie beneath the lens door 101 and reflectors 90 are shown in an exploded view. The housing 1 has an internal depth sufficient to hold the necessary electrical components for either a fluorescent or LED version. The end plates 3 include internal light seals 2 to block visual access to dark areas.

End bridges/brackets 4 or "fillers" are disposed on each end of the housing 1 to provide support for securing the LED mounting plate 21 above the chasm in the housing that is home to the internal electronics supporting the LED illumination source including the EMpack 6 and LED driver 7. The fillers 4 and mounting plate 21 are secured in place by strategically placed screws along the periphery of the mounting plate 21. Similar screws 8 or securing means are used to fasten the end caps 3 in place.

Figure 5A:
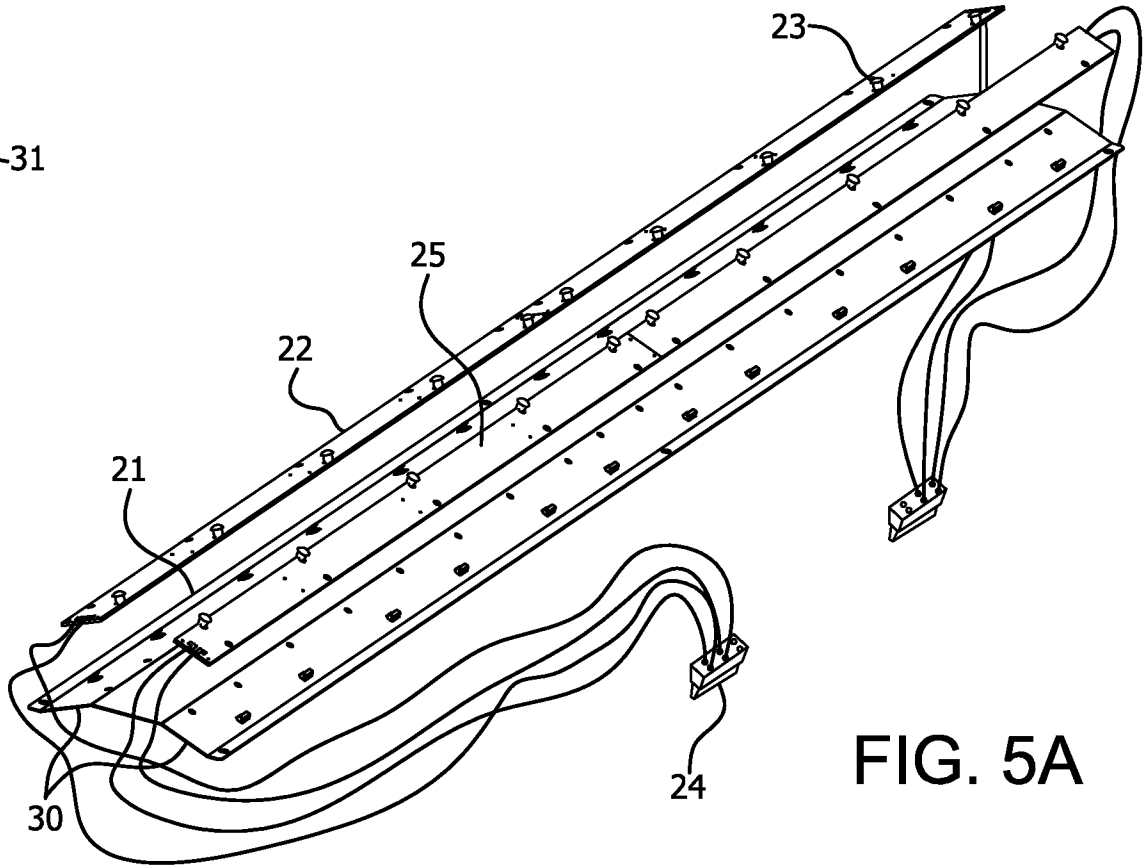
FIG. 5A depicts an exploded view of the LED mounting plate and LED strips of the embodiment of FIGS. 1-4.
Figure 5B:
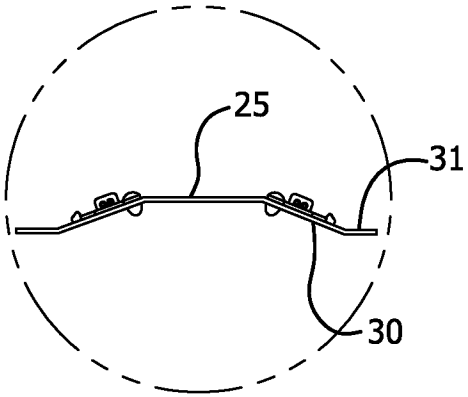
FIG. 5B depicts a front view of an assembled LED mounting plate and LED strips of the embodiment of FIGS. 1-4.

In this 1'×4' embodiment, as best shown in FIG. 5, the LED mounting plate 21 has a cross sectional design that includes a flat/horizontal central portion 25, opposing sloped sides 30, and flat/horizontal mounting/screw flanges 31 (see FIG. 5 Detail A). The sloped sides 30 are generally deflected down about 21° from horizontal. An LED PCB board is mounted by rivets 23 to each of the slope sides 30. The boards terminate with the necessary wiring and connections 24 to plug into the LED power source and driver for illuminating the LEDs.

While certainly not intuitive by any means, the present inventors have discovered that the angling of the LED boards (and LEDs) allows the ultimate light output to be vastly improved over prior art LED light fixtures that generally ran the LED boards along a central, flat mounting plate. The angling of the LEDs allows the fixture to appear almost indiscernibly the same as a fluorescent fixture (the frosted, textured, or prism central lens prevents the individual LEDs from being visible). The angling of the LEDs allows the entire face of the fixture to be illuminated (avoids the dark outside areas), which was a major drawback in the art. Prior artisans attempted to deal with the problem by changing, manipulating or adding additional reflectors; or in some cases, adding additional LEDs which affected other aesthetic aspects of the fixture.

Prior art LED luminaires often failed to provide favorable spacing criteria, sometimes falling below 1.2, due in large part to the limited 120° light output of the LEDs. The present invention now provides spacing criteria of upwards of 1.5 or more, which allows for spacing installations similar or the same as that of fluorescent lighting. In the end, the present invention provides a bat-wing distribution of lighting that is akin to that desired by fluorescent lighting.

Figure 6:
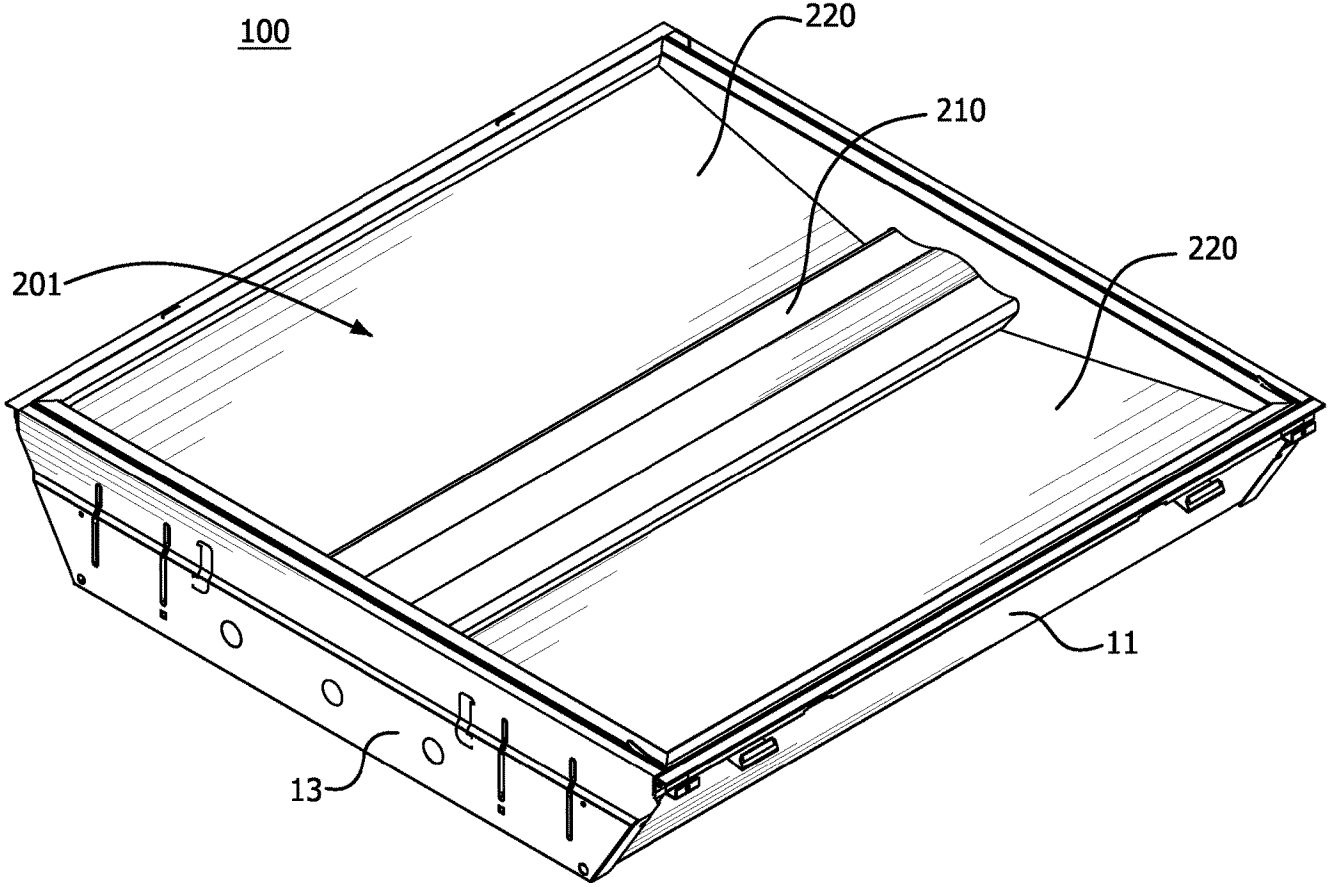
FIG. 6 depicts a perspective view of a 2'×2' architectural luminaire embodiment according to the invention.
Figure 7:
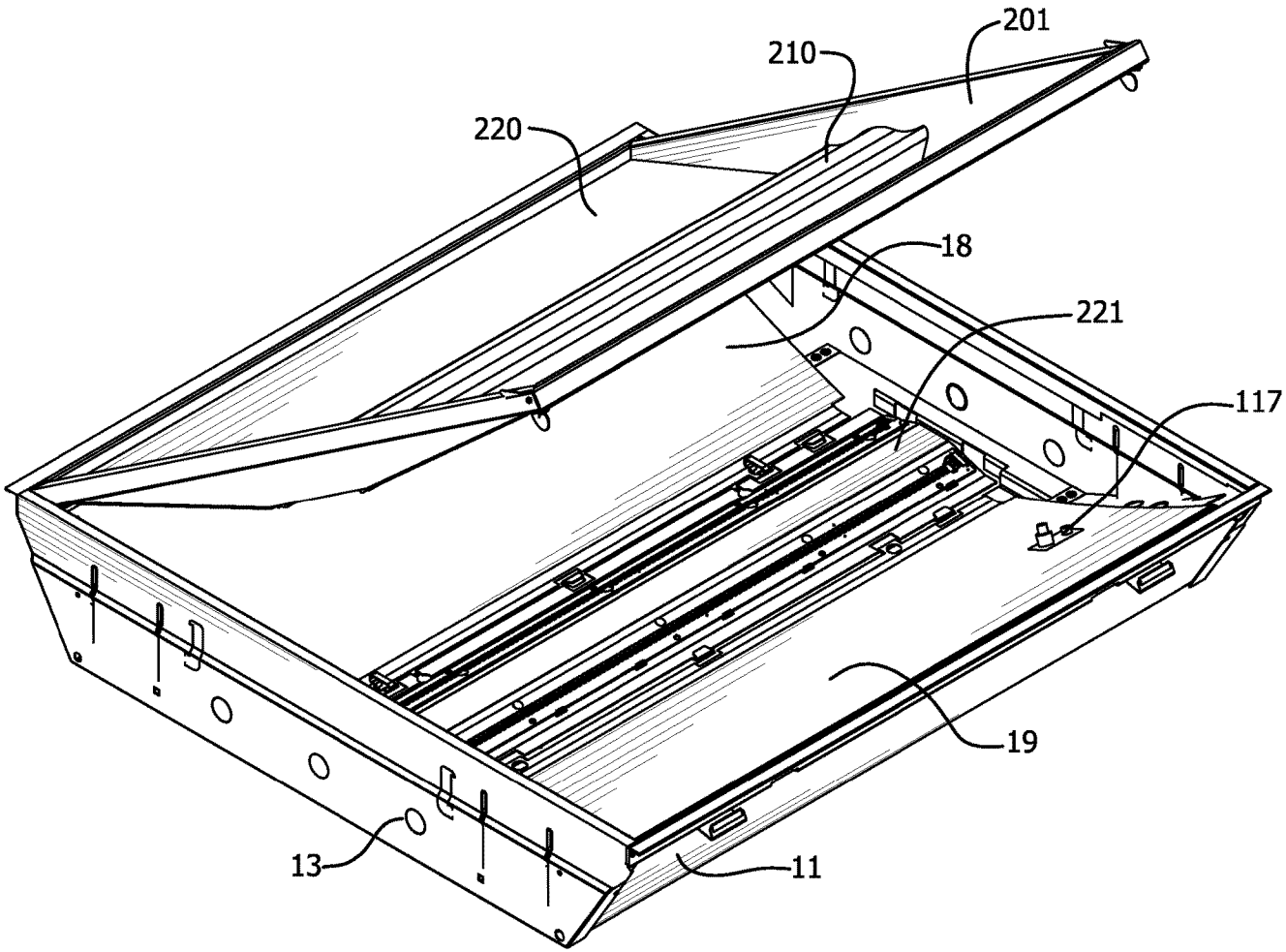
FIG. 7 depicts a perspective view of the luminaire embodiment of FIG. 6 with the lens door open.
Figure 8:
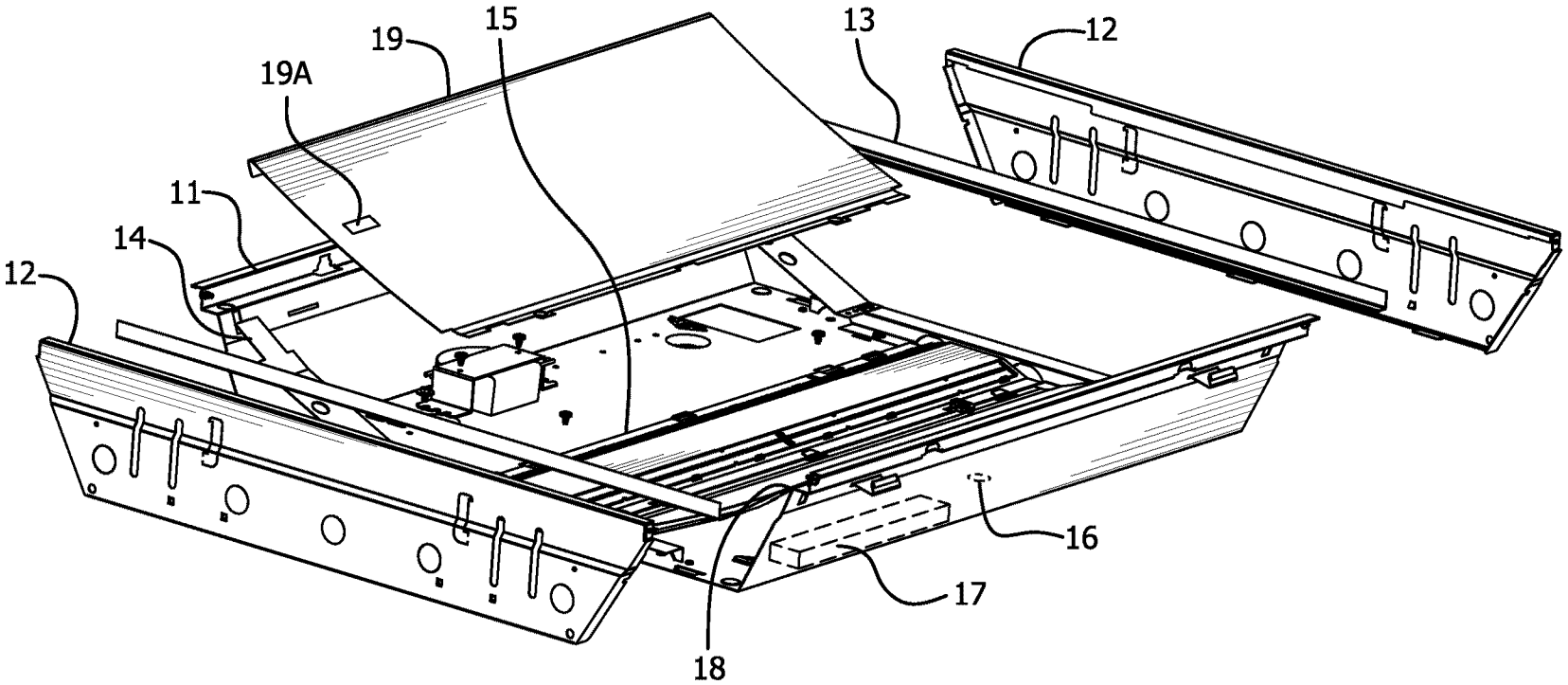
FIG. 8 is an exploded view of the luminaire of FIGS. 6 and 7 after the lens door has been removed.

FIGS. 6-9 depict an LED version of a 2'×2' SERRANO™ fixture. Similar to the embodiment of FIGS. 1-5, the fixture 100 includes a frame 11, end caps 13, and hinged lens door 201 comprising an aesthetic, prismatic central lens 210 flanked by angled flat side lenses 220 as best shown in FIG. 6. The door is pivottable to provide access to the interior of the housing as shown in FIG. 7. Unlike the 1'×4' embodiment of FIGS. 1-5, the 2'×2' version does not have a deep central trough for housing the LED driver and related electrical components. Instead, the LED driver 7 and related components and actuators 117 are housed under the pivottable side reflectors 18 and 19. One of the side lenses 19 includes a cutout 19A for actuators 117 as best shown in FIG. 8.

Continuing with FIG. 8, the housing 11, light seals 12, and end caps 13 are sized for the different dimensions of this embodiment. The mounting plate is secured by screws 15 to the bottom of the fixture housing 100 and flanked by reflectors 18 and 19, which includes cut out 19A. The LED driver 17 is positioned beneath reflector 18, while reflector 19 covers other components and includes the cutout 19A for actuators 117 and features 14.

Figure 9:
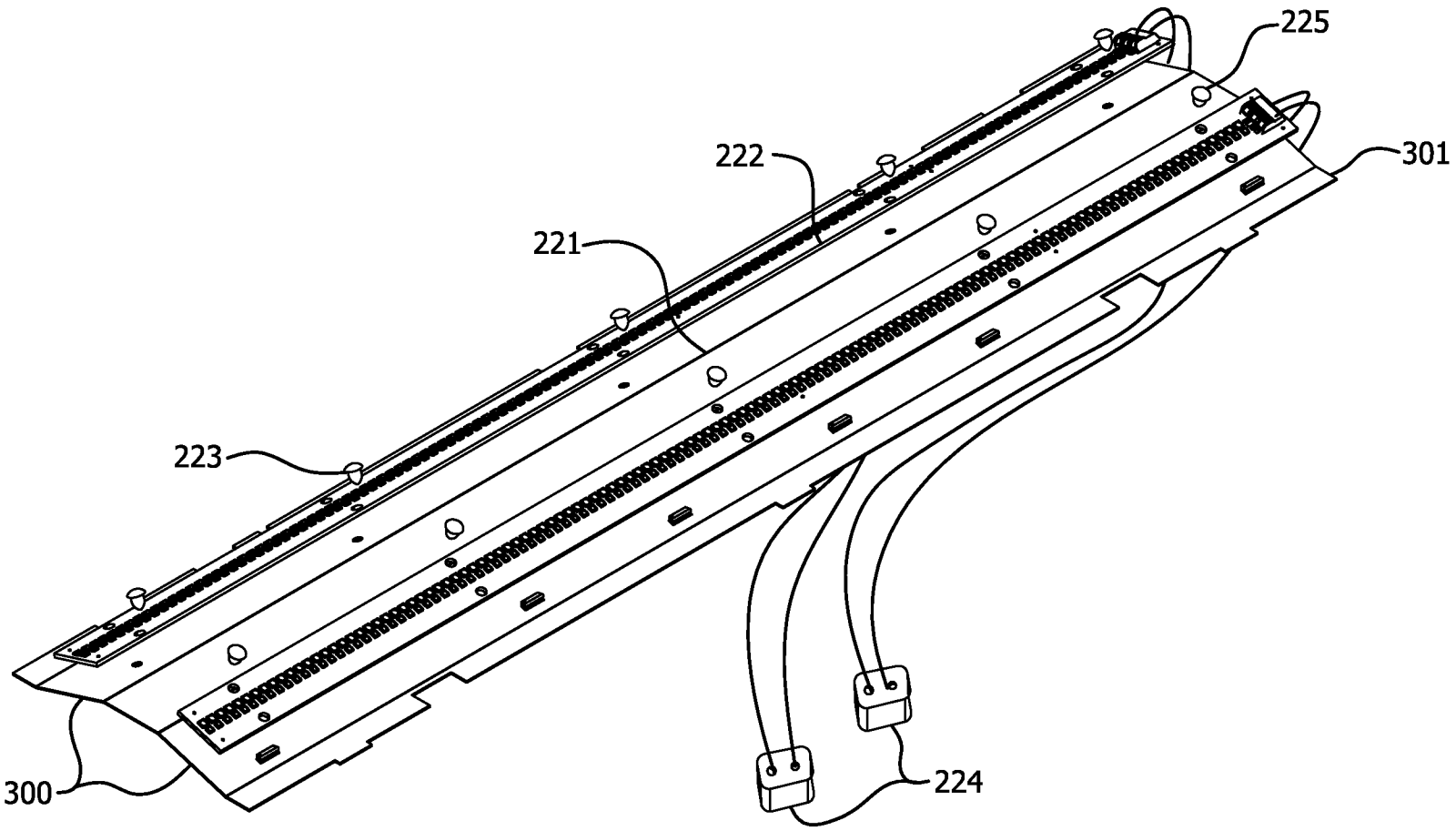
FIG. 9 depicts various views and details of the LED mounting plate and LED strips of the embodiment of FIGS. 6-8.

FIG. 9 depicts the LED mounting plate and related components. As with the previous embodiment, the LED mounting plate 221 has a central flat portion 225 flanked by downwardly angled side portions 300 terminating at flat flanges 301. LED PCB boards 222 are attached to each angled side portion with rivets 223. The necessary wiring 224 extends form the LED boards 222 for carrying power to the LEDs. Again, the angle of the LED boards allows for the entire face of the fixture to be illuminated to avoid outside dark areas and ensure a bat-wing distribution of light sufficient to provide favorable spacing criteria approaching 1.5 or greater.

Figure 10:
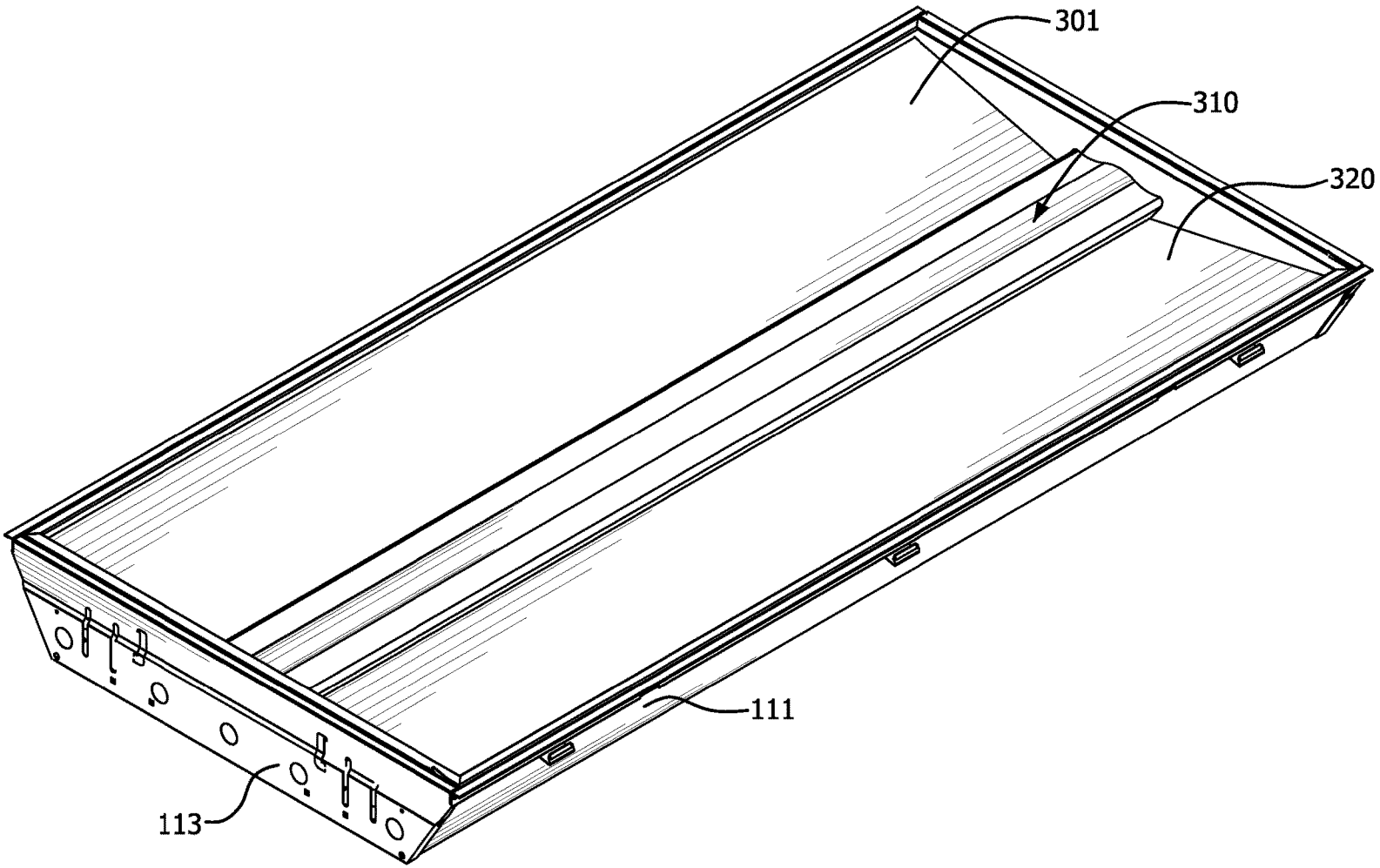
FIG. 10 depicts a perspective view of a 2'×4' architectural luminaire embodiment according to the invention.
Figure 11:
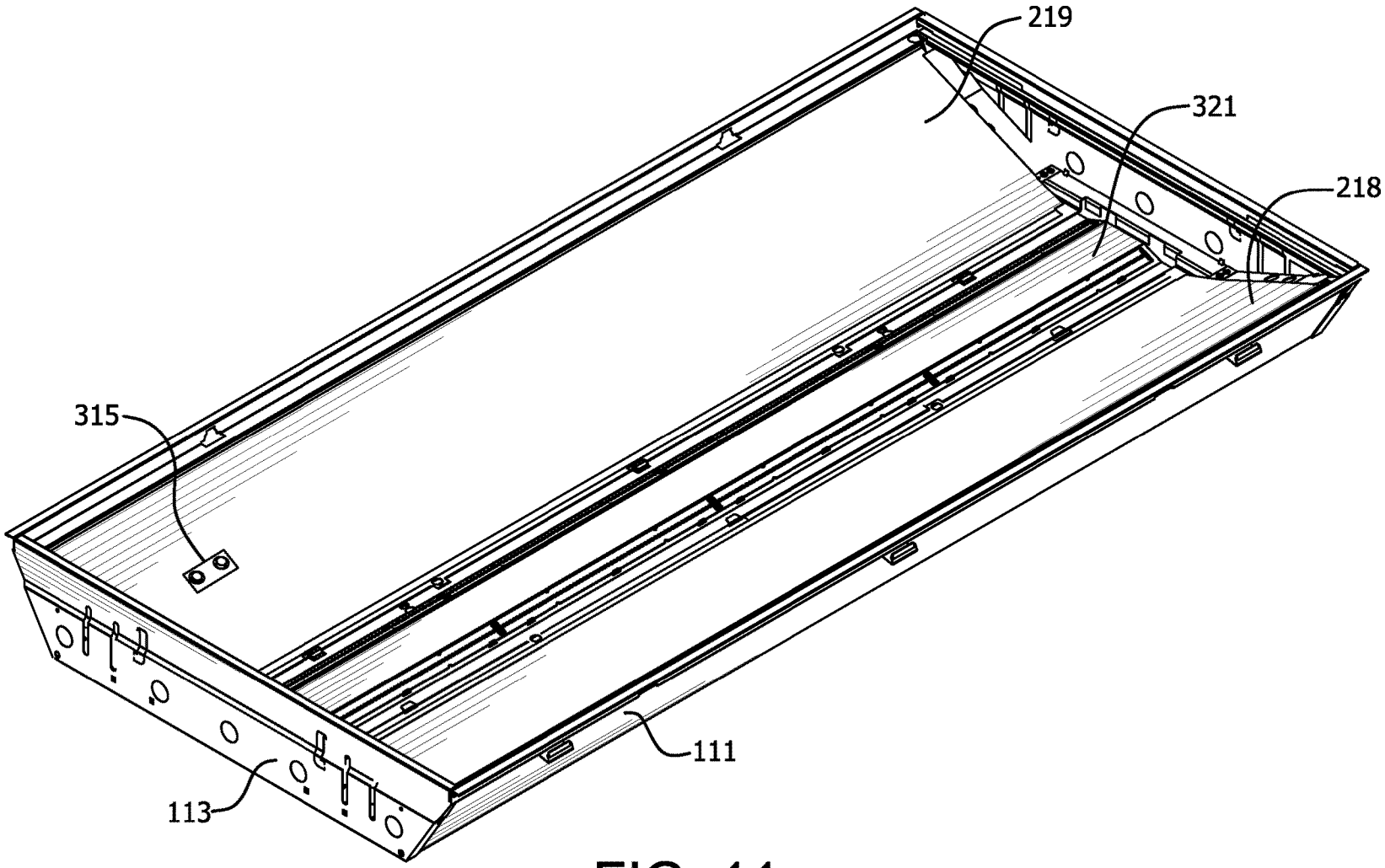
FIG. 11 depicts a perspective view of the luminaire embodiment of FIG. 10 with the lens door open removed.
Figure 12:
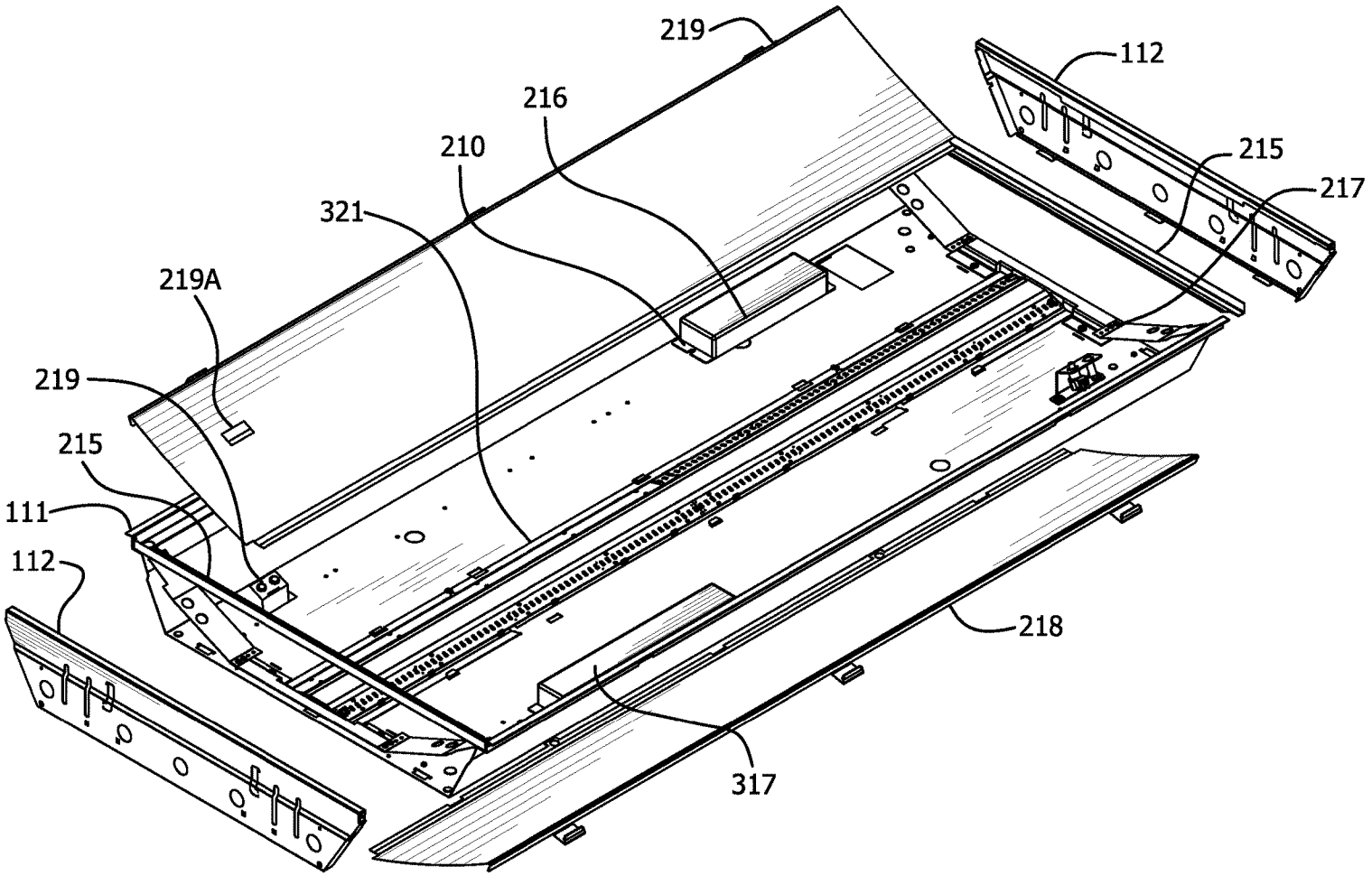
FIG. 12 is an exploded view of the luminaire of FIGS. 10 and 11 after the lens door has been removed.

FIGS. 10-13 depict an LED version of a 2'×4' SERRANO™ fixture. Similar to the embodiment of FIGS. 1-5 and 6-9, the fixture 100 includes a frame 111, end caps 113, and hinged lens door 301 comprising an aesthetic, prismatic central lens 310 flanked by angled flat side lenses 320 as best shown in FIG. 10. Similar to the other embodiments, the door 301 is pivottable to provide access to the interior of the housing 111. Also, similar to the 2'×2' version the LED driver 216 and related components and actuators 315 are housed under the pivottable side reflectors 218 and 219. Again, one of the side lenses 219 includes a cutout 219A for actuators 315 as best shown in FIG. 12.

Continuing with FIG. 12, the housing 111 and end caps 112 are sized for the different dimensions of this embodiment. The mounting plate 321 is secured to the bottom of the fixture housing 100 and flanked by reflectors 218 and 219. The LED driver 216 is positioned beneath reflector 219 which also includes other components underneath such as actuators 315 which poke through cutout 219A. Underneath reflector 218 are other electrical components 317.

Figure 13A:
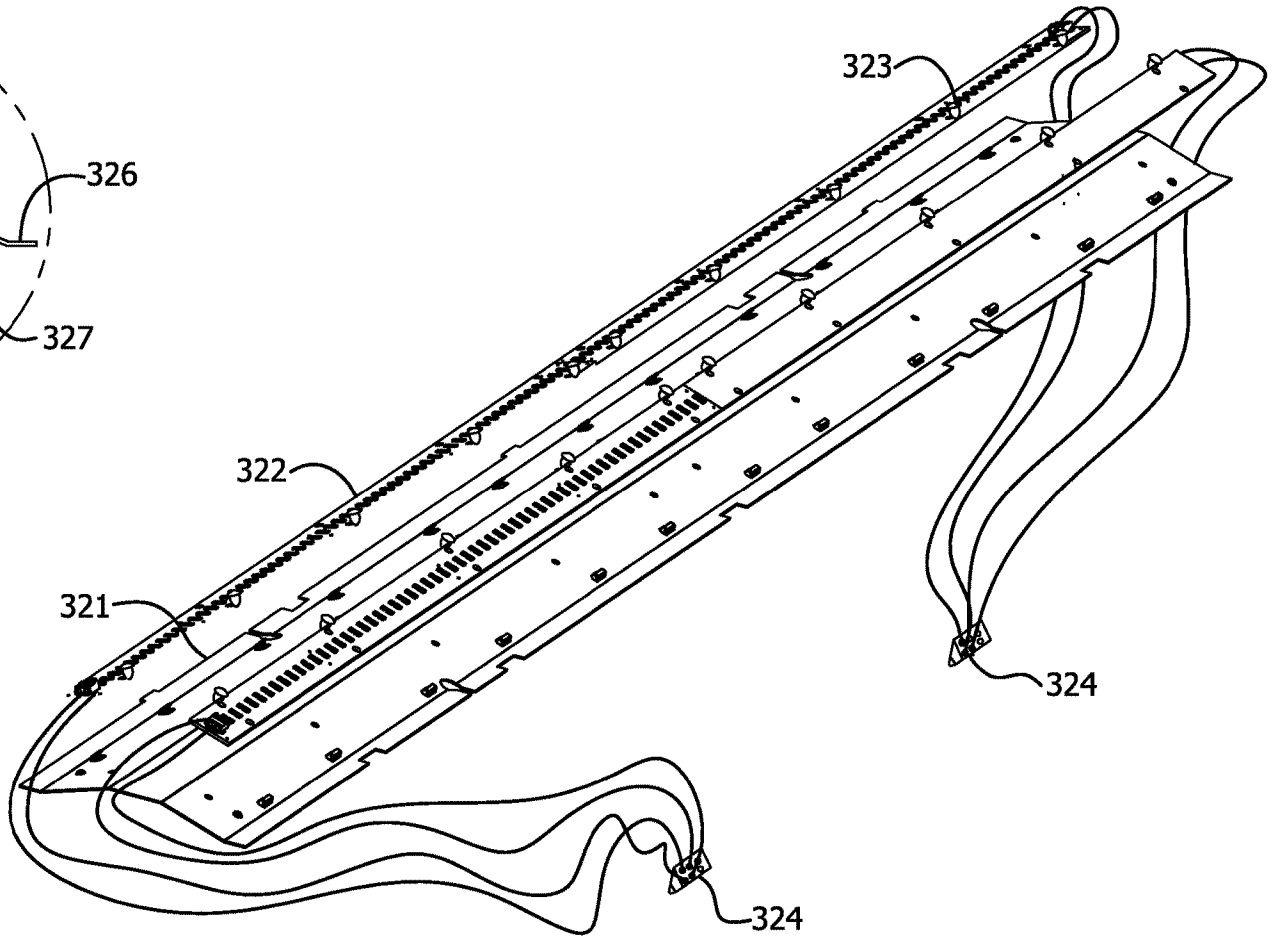
FIG. 13A depicts an exploded view of the LED mounting plate and LED strips of the embodiment of FIGS. 10-12.
Figure 13B:
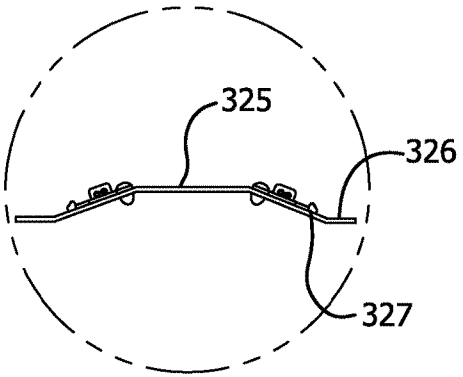
FIG. 13B depicts a front view of an assembled LED mounting plate and LED strips of the embodiment of FIGS. 10-12.

As shown in the various views in FIG. 13, the LED mounting plate 321, consistent with the other embodiments, has a central flat portion 325 flanked by downwardly angled side portions 326 terminating at flat flanges 327. LED PCB boards 322 are attached to each angled side portion 326 with rivets 323. The necessary wiring 324 extends from the LED boards 322 for carrying power to the LEDs. Again, the angle of the LED boards, as best shown in FIG. 13 Detail A, allows for the entire face of the fixture to be illuminated to avoid outside dark areas and ensure a bat-wing distribution of light sufficient to provide favorable spacing criteria approaching 1.5 or greater.

As will now be readily appreciated by one of ordinary skill in the art armed with the present specification, the inventive methods of the present invention lend themselves to configuring LED lighting fixtures that mimic the aesthetic and lighting characteristics of fluorescent lighting common in the industry by manipulating the angle of the LED boards in conjunction with the provision of the other features discussed herein and shown in the figures. For example, the presently preferred 21° angle of the LED boards discussed in connection with a presently preferred embodiment was based on a number of factors specific to the configuration of the fixture, and in particular, the 2.912 inch distance between the LED mounting plate and the apex of the central lens.

The foregoing embodiments and advantages are merely exemplary and are not to be construed as limiting the scope of the present invention. The description of an exemplary embodiment of the present invention is intended to be illustrative, and not to limit the scope of the present invention. Various modifications, alternatives and variations will be apparent to those of ordinary skill in the art, and are intended to fall within the scope of the invention.

We claim:

1. An LED architectural luminaire comprising:

a housing defining a light channel;

an LED mounting plate disposed in said channel, said LED mounting plate including a pair of sloped surfaces descending at an angle away from a raised central flat portion and towards said housing;

a pair of LED strips mounted on each of a respective sloped surface of said LED mounting plate;

a pair of reflectors disposed adjacent a respective sloped surface of said LED mounting plate; and a lens assembly disposed above said LED mounting plate, said LED strips being oriented towards said lens assembly, said lens assembly comprising a central prismatic lens flanked by a pair of side lenses, wherein said pair of side lenses descend at an angle from said central prismatic lens to an outer perimeter of the lens assembly.

2. The luminaire of claim 1 wherein said sloped sides are angled at a slope of about 20° to 30°.

3. The luminaire of claim 2, wherein said slope is about 21°.

4. The luminaire of claim 1, wherein said housing comprises a body and a pair of end caps.

5. The luminaire of claim 4, further comprising light seals disposed in an area adjacent said end caps.

6. An LED architectural luminaire comprising:

an elongated housing comprising a pair of elongated side walls and a pair of end caps;

a pivotable lens door longitudinally hinged to one of said elongated side walls and pivotable away from said housing, said lens door comprising a central prismatic lens and pair of side lenses;

an elongated LED mounting plate disposed beneath said lens door including a pair of sloped surfaces descending at an angle away from a raised central flat portion and away from said lens door, said pair of sloped surfaces running longitudinally in said housing;

a pair of LED strips mounted on each of a respective sloped surface of said LED mounting plate and facing said lens door; and a pair of reflectors disposed adjacent a respective sloped surface of said LED mounting plate, wherein said pair of side lenses descend at an angle from said central prismatic lens to an outer perimeter of the lens door.

7. The LED architectural luminaire of claim 6, wherein said LED mounting plate is attached to a back inside surface of said housing.

8. The LED architectural luminaire of claim 6, wherein said sloped surfaces are at an angle between about 20° and 30° from horizontal.

9. The LED architectural luminaire of claim 6, wherein said sloped surfaces are at an angle of 21° from horizontal.

10. The LED architectural luminaire of claim 9, wherein said LED mounting plate is a distance of about 2.9 inches from said central len's apex.

11. The LED architectural luminaire of claim 6, wherein said end caps include light seal elements.

12. The LED architectural luminaire of claim 6, wherein said at least one of said reflectors is pivotable.

13. The LED architectural luminaire of claim 12, wherein a driver for said LED strips is housed under said pivotable reflector.

14. The luminaire of claim 1, wherein said lens assembly is pivotably connected to the housing.

15. The luminaire of claim 1, wherein said LED strips produce a bat-wing type light distribution through the lens assembly.

16. The luminaire of claim 1, wherein a bracket connects said mounting plate to said housing.

17. The luminaire of claim 6, wherein said LED strips produce a bat-wing type light distribution through the lens door.

18. The luminaire of claim 6, wherein a bracket connects said mounting plate to said housing.

19. The luminaire of claim 11, wherein said light seals block visual access to dark areas of said housing.

* * * * *